US005800045A

United States Patent [19]

Kish et al.

[11] Patent Number: 5,800,045

[45] Date of Patent: Sep. 1, 1998

[54] LANTERN

[75] Inventors: Paul Kish, Wilkes-Barre; Randy S. Cramer, Lebanon, both of Pa.

[73] Assignee: Bright Star Industries, Inc., Wilkes-Barre, Pa.

[21] Appl. No.: 736,991

[22] Filed: Oct. 25, 1996

[51] Int. Cl.[6] ..... F21L 1/00

[52] U.S. Cl. ..... 362/205; 362/202; 362/306; 362/375

[58] Field of Search ..... 362/157, 200, 362/202, 203, 204, 205, 206, 306, 362, 374, 375, 390

[56] References Cited

U.S. PATENT DOCUMENTS

| | | | |
|---|---|---|---|
| 3,172,094 | 3/1965 | Jones | 362/203 |
| 3,539,797 | 11/1970 | Brindley et al. | 362/202 |
| 4,181,928 | 1/1980 | Zelina | 362/200 |
| 4,237,526 | 12/1980 | Wood | 362/202 |
| 4,286,311 | 8/1981 | Maglica | 362/205 |
| 4,323,879 | 4/1982 | Kelley | 362/157 |
| 4,703,402 | 10/1987 | Hsieh | 362/205 |
| 4,737,892 | 4/1988 | Ohashi | 362/206 |
| 4,951,183 | 8/1990 | Wang | 362/205 |
| 5,272,606 | 12/1993 | Blaney | 362/205 |

FOREIGN PATENT DOCUMENTS

| | | | |
|---|---|---|---|
| 460062 | 9/1913 | France | 362/390 |
| 162735 | 5/1921 | United Kingdom | 362/390 |
| 184302 | 8/1922 | United Kingdom | 362/390 |

*Primary Examiner*—Alan Cariaso
*Attorney, Agent, or Firm*—Nies, Kurz, Bergert & Tamburro

[57] ABSTRACT

A portable hand carried lantern comprising components which may be quickly snapped together without the use of tools. A battery contact platform separates the battery chamber and bulb chamber and includes a plurality of contact strips by which the electrical circuit is automatically established without the use of wires upon assembly of the components. A safety disconnect system incorporated in the bulb chamber and battery contact platform that prevents explosion in a flammable atmosphere should the bulb break.

9 Claims, 3 Drawing Sheets

LANTERN

BACKGROUND AND SUMMARY OF THE INVENTION

This invention relates generally to a portable hand carried lighting apparatus and more particularly, to a safety apparatus (i.e., V/L, MSHA, CSA) portable lantern.

In the portable lighting industry, there is an increasing demand to produce reliable lanterns at reasonable cost, with a rated explosion proof safety mechanism.

Accordingly, the primary object of this invention is to provide a portable lighting device, such as a lantern, whose components may be quickly snapped together with the electrical circuit established by wireless battery contact for trouble-free use.

Another object of the invention is to provide the above novel lantern in which the components are easily assembled without the use of tools or the use of wires to connect the battery and complete the electrical circuit.

Still another object of the invention is to provide the above novel lantern wherein the bulb and battery are protected against excess shock should the lantern be dropped.

A further object of the invention is to provide the above novel lantern in which the lens and reflector are snapped together and may be quickly unsnapped to facilitate changing of a bulb without requiring tools.

Another object of the invention is to provide the above novel lantern which includes a battery contact platform that separates the battery chamber from the bulb chamber and includes a plurality of contact strips by which the electrical circuit is automatically established without the use of wires upon assembly of the components.

Still other objects and advantages will become apparent upon reading the following detailed description of the invention, wherein reference is made to the accompanying drawings.

DETAILED DESCRIPTION OF THE INVENTION

Figure 1:
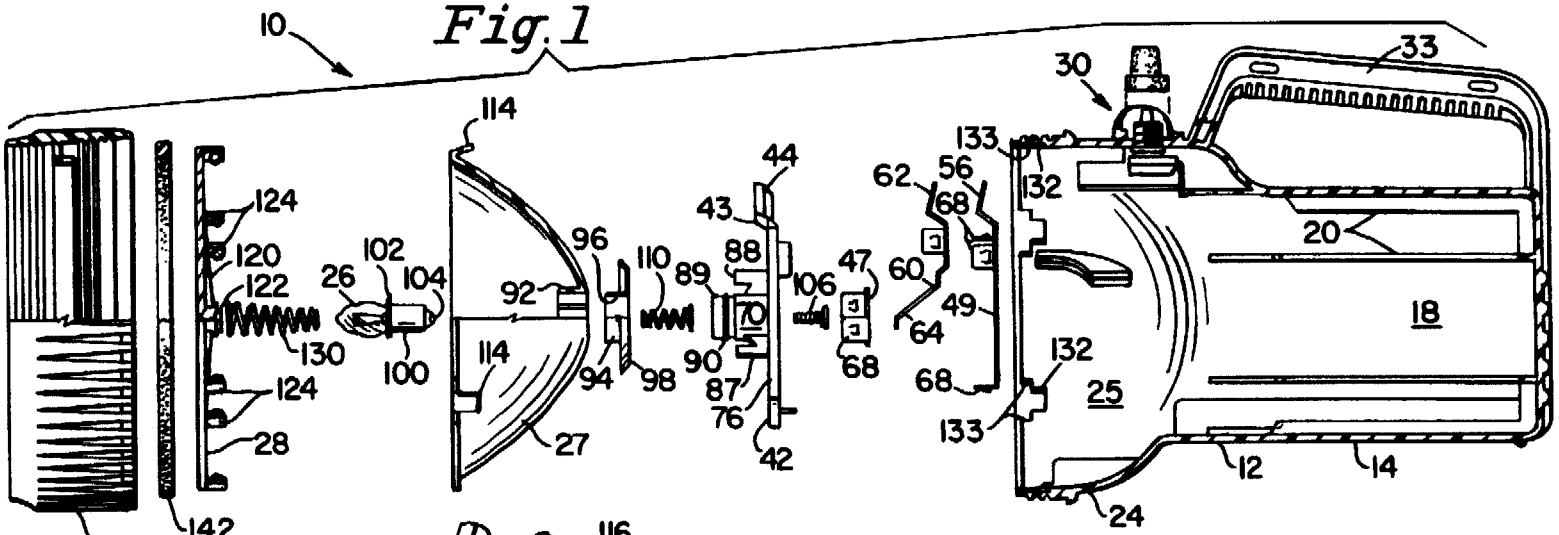
FIG. 1 is a partially fragmented exploded view of the novel lantern of the invention.
Figure 6:
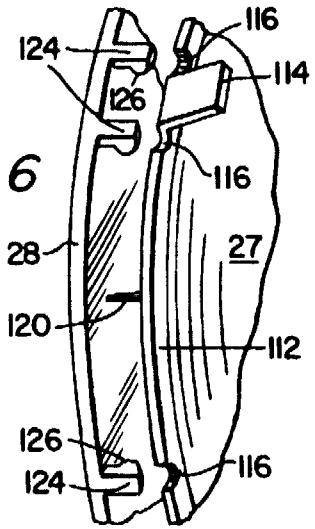
FIG. 6 is a fragmentary perspective view illustrating how the lens and reflector are snapped together.

Referring now to the drawings, the novel hand held battery operated lantern 10 includes a hollow plastic housing or box 12 having a rear portion 14 of generally rectangular construction closed by an end wall 16. Rear portion 14 defines a battery receiving chamber 18 and includes a plurality of internal longitudinally extending ribs 20 within which a lantern battery 22 is closely received and centered within chamber 18.

The forward open ended portion 24 of box 12 is generally cylindrical in shape and defines a front or forward chamber 25 at the open end of the box in axial alignment with chamber 18. A bulb 26, a parabolic reflector 27, and a lens 28 are mounted within chamber 25 as will be described hereinafter. A switch housing 29 is formed on the top of box 12 extending between portions 14 and 24, and a pushbutton switch 30 is mounted within housing 29 and includes electrical terminals 31 and 32.

Figure 2:
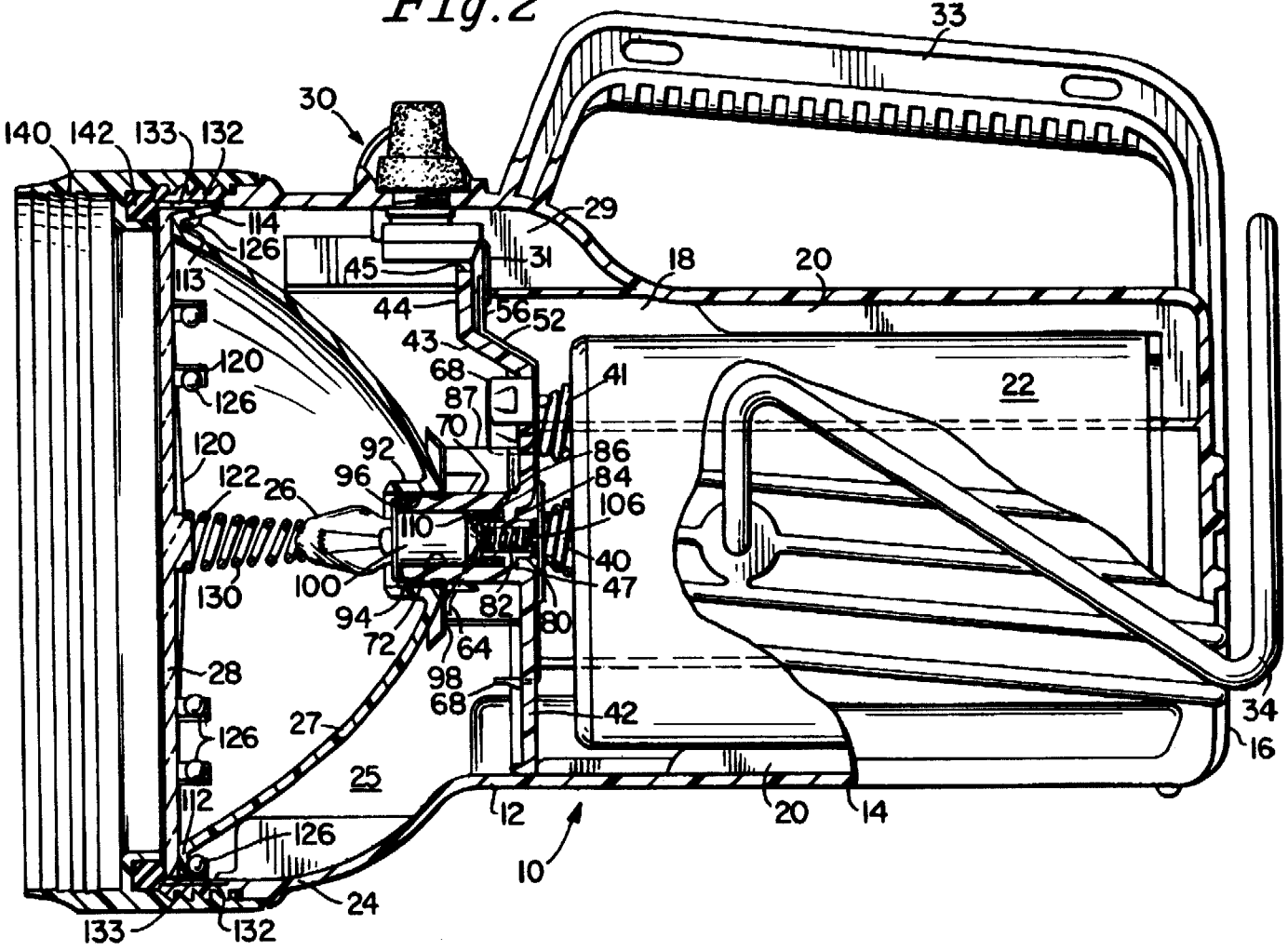
FIG. 2 is a fragmentary sectional view of the assembled lantern.

A handle 33 is formed integrally on the box and a pivotal wire stand 34 is connected to the sides of portion 14 and is movable between the horizontal position shown in FIG. 2 and a 90° vertical support position (not shown).

Battery 22 is a conventional 6 volt battery, rectangular in cross section, and includes a negative spring terminal 40 positioned on the central axis of the battery and a spring terminal 41, which is offset radially at 45° from terminal 40. Battery 22 is retained within chamber 18 by a transverse plastic platform element 42, of generally rectangular configuration which separates chamber 18 from chamber 25. Platform 42 has a forwardly extending, upwardly inclined wall 43 joining a vertical wall 44 having an open central slot 45 and beveled side edges 46.

A negative contact strip 47 is centrally mounted on the back face 48 of platform 42 for engagement by battery terminal 40. Similarly a U-shaped platform contact strip 49 having sides 50 and 52 connected by a base 54 is mounted on the back face of platform 42 with leg 52 having a forwardly and upwardly extending contact finger 56 which engages against terminal 31 of switch 29. Contact strip 49 is designed so that regardless of how battery 22 is placed into chamber 18, battery terminal 41 will engage one of the legs 50 or 52 or base 54. A positive contact strip 60 is also mounted on the back face of platform 42 and includes a forwardly and upwardly extending contact finger 62 which engages against switch terminal 32. Contact strip 60 also has a contact finger 64 that extends downwardly and forwardly through a slot 66 in platform 42 into chamber 25 to form part of the electrical circuit of the system. Each contact strip 47, 49, and 60 has retainer tabs 68 bent at right angles and extending through slots in platform 42 to hold the strips in place.

Figures 3, 4, 5:
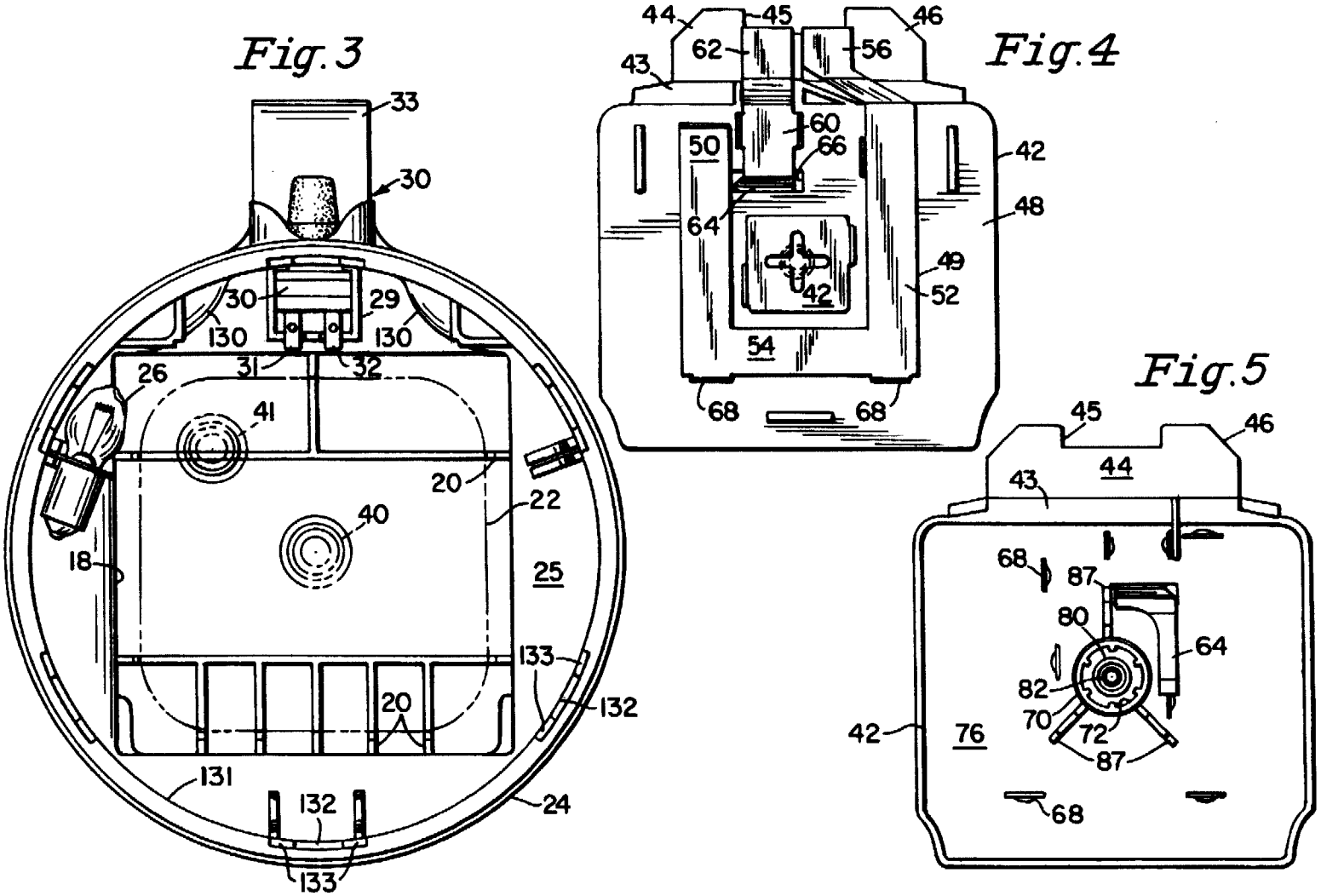
FIG. 3 is an end view of the open lantern box.
FIG. 4 is a back view of the battery contact platform.
FIG. 5 is a front view of the battery contact platform.

As shown in FIGS. 1, 2 and 5, a central tubular hub 70 having an enlarged front bore 72 is formed integrally with and extends forwardly from the front face 76 of platform 44. A second reduced diameter hub 80 having a smaller through bore 82 is concentrically mounted within the rear portion of hub 70 via a radial wall 84 to form counterbore 86 between the outer wall of hub 82 and the inner wall of hub 70. A plurality of reinforcing ribs 87 with end faces 88 extend between hub 70 and face 76 of platform 42.

Reflector 27 has a central hub 92 which snugly receives a metallic bushing 94 having an inwardly extending radial end flange 96 at its outer end and an outwardly extending radial flange 98 at its inner end. The outer end 89 of hub 70 has a slightly larger band 90 which fits snugly in bushing 94 and end faces 88 abut against flange 98.

Bulb 26 includes the usual base 100 which suitably fits within bore 72, a conductive flange 102 which engages against flange 96, and a conductive base terminal 104 which engages against a small contact spring 106 extending within bore 82 through an opening in platform 42 into contact with strip 47. A biasing spring 110 fits within counterbore 86 and engages against the bottom of base 100 around terminal 104.

Reflector 27 has an outer end flange 112 on which three equally spaced rearwardly extending resilient tabs 114 are formed. On each side of tabs 114 and at equally spaced locations therebetween a pair of semicircular slots 116 are formed on the peripheral edge of flange 112.

Lens 28 has a plurality of radially extending reinforcing ribs 120 centered around hub 122 and a plurality of equally spaced pairs of rearwardly protecting pins 124 having inner spherical dimples 126 spaced inwardly from inner face 128 of lens 28. A conical spring 130 has its large end fitting snug on hub 122 and its small end adapted to fit over the outer end of bulb 26. When assembled spring 130 has a greater spring force than springs 106 and 110.

The components of lantern 10 are quickly and easily assembled together without any special tooling and without having to use and connect any electrical wires to the battery. Contact strips 47, 49 and 60 are snapped into place on the back face 49 of platform 42. Spring 106 is placed into bore 82 and spring 110 is placed into counterbore 86. Bushing 94 is pushed into hub 92 and the forward end 89 of hub 70 is pushed into bushing 94.

Base 100 of bulb 26 is slid into bore 72. Spring 130 is fixed on hub 122 and lens 28, with the inner end of spring 130 engaging over the outer end of bulb 26 and is snapped together with reflector 27 by placing pins 124 through slots 116 and snapping dimples 126 against the inside face 113 of flange 112.

Battery 22 is placed in chamber 18 supported and centered on ribs 20. The platform, bulb, reflector and lens subassembly is then placed into chamber 25 with slot 45 aligned with and clearing switch housing 29 and with beveled edges 46 being guided by corresponding beveled surfaces 130 on box 12. As shown in FIG. 2, the back face 49 of the platform engages against the front edges of ribs 20 and contact fingers 56 and 62 engage against switch terminals 31 and 32, respectively.

As shown in FIGS. 1, 2, and 3, the front open end 13 of chamber 25 has a plurality of equally spaced recesses 132, 133 within which tabs 114 and pins 124 respectfully snap to hold the components in place as shown in FIG. 2. A lens ring 140 holds a gasket 142 which engages against the outer peripheral face of lens 28 as the ring is threaded onto the outer surface of portion 24.

With the components thus assembled as shown in FIG. 2, the electrical circuit is thus automatically established through battery terminal 41, contact strip 48, finger 56, switch terminals 31, 32, finger 62 of contact strip 60, finger 64, flange 48, bushing 94 and flange 96, bulb flange 102 and terminal 104, contact spring 106, contact strip 47, and battery terminal 40.

In addition, should lantern 10 be dropped, platform 42 and springs 110 and 130 help protect the bulb from excess shock. Also, internal ribs 20 and platform 42 protect battery 22 from excess shock.

With the described snap together construction, it is easy to change a bulb 26. Lens ring 140 is removed, lens 28 is separated from reflector 27 by unsnapping pins 124 from slots 116,a new bulb is put in place, and lens 28 is resnapped onto reflector 27.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A portable lantern comprising a housing having a rear portion defining a rear battery receiving chamber and a forward portion defining a front chamber having an open front end; a lens, reflector, and bulb mountable within said front chamber; a switch assembly mounted on said housing and having electrical terminal means; a transverse platform removably mounted in said housing and separating said rear and front chambers, said platform having electrical contact means which automatically establishes an electrical circuit between a battery in said rear chamber, said switch terminal means and said bulb upon insertion of said platform into said housing; first cooperating snap retainer means on said lens and said reflector for quickly connecting said lens and said reflector together; and second cooperating snap retainer means on said reflector and said housing forward portion around said open front end for quickly connecting said reflector to said housing.

2. The lantern defined in claim 1, said platform having a tubular hub extending forwardly into said front chamber; a conductive bushing mounted on said hub, said reflector having a central opening, said hub and said bushing fitting within said central opening; said bulb having a base fitting within said hub, a base terminal and a flange engaging said bushing; a first spring holding said bulb in said hub with said flange engaging said bushing, a second contact spring mounted within said hub and electrically connecting said base terminal to said platform contact means.

3. The lantern defined in claim 2, comprising a third spring mounted within said hub in surrounding relationship with said contact spring and urging said bulb out of said hub, said spring resiliently mounting said bulb in said hub to prevent excess shock on said bulb.

4. The lantern defined in claim 1, comprising cooperating guide means on said platform and said housing for ensuring proper positioning of said platform in said housing.

5. The lantern defined in claim 4, said platform having a tubular hub extending forwardly into said front chamber; a conductive bushing mounted on said hub, said reflector having a central opening said hub and said bushing fitting within said central opening; said bulb having a base fitting within said hub, a base terminal and a flange engaging said bushing; a first spring holding said bulb in said hub with said flange engaging said bushing, a second contact spring mounted within said hub and electrically connecting said base terminal to said platform contact means.

6. The lantern defined in claim 5, comprising a battery within said rear chamber having at one end a first central terminal and a second radially displaced terminal; said platform electrical contact means comprising a first contact strip connecting said first battery terminal to said second contact spring, a second contact strip connecting said second battery terminal to said switch terminal means, and a third contact strip connecting said bushing to said switch terminal means.

7. The lantern defined in claim 6, said second contact strip being configured so that it engages said second battery terminal regardless of the radial orientation of said battery in said rear chamber.

8. The lantern defined in claim 7, said rear chamber having a plurality of longitudinally extending ribs which closely support said battery within said chamber.

9. The lantern defined in claim 5, comprising a third spring mounted within said hub in surrounding relationship with said contact spring and urging said bulb out of said hub, said springs resiliently mounting said bulb in said hub to prevent excess shock on said bulb should the lantern be dropped.

* * * * *